US006227906B1

(12) United States Patent
Fan

(10) Patent No.: US 6,227,906 B1
(45) Date of Patent: May 8, 2001

(54) CONNECTOR TO CIRCUIT BOARD SECURING ARRANGEMENT

(75) Inventor: Chia-Hao Fan, Shu-Lin (TW)

(73) Assignee: Hon Nai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/469,153

(22) Filed: Dec. 21, 1999

(51) Int. Cl.[7] ..... H01R 13/73
(52) U.S. Cl. ..... 439/570
(58) Field of Search ..... 439/570, 571–573, 439/567

(56) References Cited

U.S. PATENT DOCUMENTS 4,907,987 * 3/1990 Douty et al. ..... 439/571
5,096,440 * 3/1992 Katsumata ..... 439/570
5,228,870 * 7/1993 Gorenc et al. ..... 439/567
5,297,966 * 3/1994 Brennian, Jr. et al. ..... 439/570
6,022,244 * 2/2000 Chiu ..... 439/570
6,042,420 * 3/2000 Long ..... 439/570

* cited by examiner

*Primary Examiner*—Gary F. Paumen
(74) *Attorney, Agent, or Firm*—Wei Te Chung

(57) ABSTRACT

An arrangement for securing an electrical connector to a printed circuit board in accordance with the present invention comprises an insulative housing comprising a pair of plates formed on a lower outer surface of a side wall, and a holding device. The plates define a guiding channel therebetween and a pair of engaging grooves between the plates and the side wall and in communication with the guiding channel. The holding device comprises an interferential portion interferentially received in the engaging grooves and confined by the plates, a transitional portion movable in the guiding channel, and a mounting portion mounting to a printed circuit board.

1 Claim, 4 Drawing Sheets

CONNECTOR TO CIRCUIT BOARD SECURING ARRANGEMENT

BACKGROUND OF THE INVENTION

1. Field of the Invention

The present invention relates to electrical connectors, and particularly to an arrangement for securing an electrical connector to a printed circuit board.

2. Description of the Prior Art

U.S. Pat. Nos. 5,228,870 and 4,907,987 disclose a connector to circuit board securing arrangement including a planar barbed holding device installed within a recess of a mounting portion on a connector for subsequent insertion into an appropriately aligned cavity in a printed circuit board. The recess of the connector is open to a lower mounting face of the connector, so the holding device needs to be first inserted into the recess of the connector from the lower side of the connector, and then engaged with the cavity of the printed circuit board. The assembly procedure is complicated and the placement of the holding device is difficult, thereby decreasing production efficiency. The connection of the holding device with the electrical connector and the printed circuit board is apt tQ loosen, thereby reducing the stability of the mechanical connection between the electrical connector and the printed circuit board.

Therefore, an improved arrangement is desired to overcome the disadvantages of the prior art.

SUMMARY OF THE INVENTION

A first object of the present invention is to provide a connector to circuit board securing arrangement which is easier to assemble; and A second object of the present invention is to provide a connector to circuit board sting arrangement which ensures the stability of the mechanical connection between the connector and the printed circuit board and of the orientation of a holding device thereof.

An electrical connector in accordance with the present invention comprises an insulative housing, a plurality of electrical contacts mounted in the insulative housing, and a holding device.

The insulative housing comprises a top wall, a bottom wall, and two side walls. One of the side walls forms a pair of plates on a lower outside surface thereof, the plates defining a guiding channel therebetween and a pair of engaging grooves between the plates and the side wall and in communication with the guiding channel.

The holding device includes an interferential portion, a transitional portion, and a mounting portion. The interferential portion is interferentially fitted into the engaging grooves of the insulative housing. The mounting portion is secured to a printed circuit board and is connected with the interferential portion via the transitional portion.

Other objects, advantages and novel features of the invention will become more apparent from the following detailed description of the present embodiment when taken in conjunction with the accompanying drawings.

DETAILED DESCRIPTION OF THE INVENTION

Figure 1:
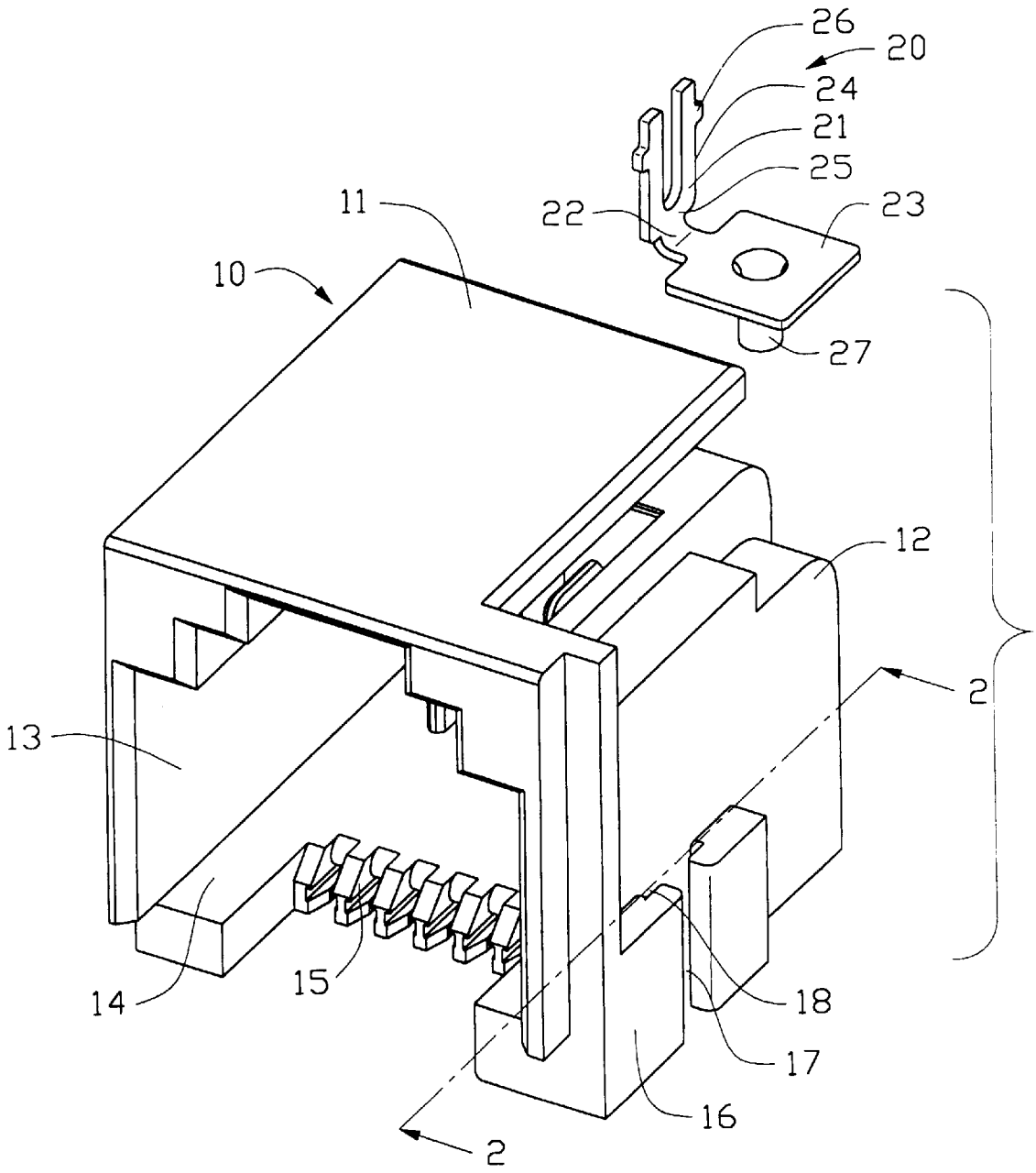
FIG. 1 is a perspective view of an electrical connector in accordance with a first embodiment of the present invention.
Figure 2:
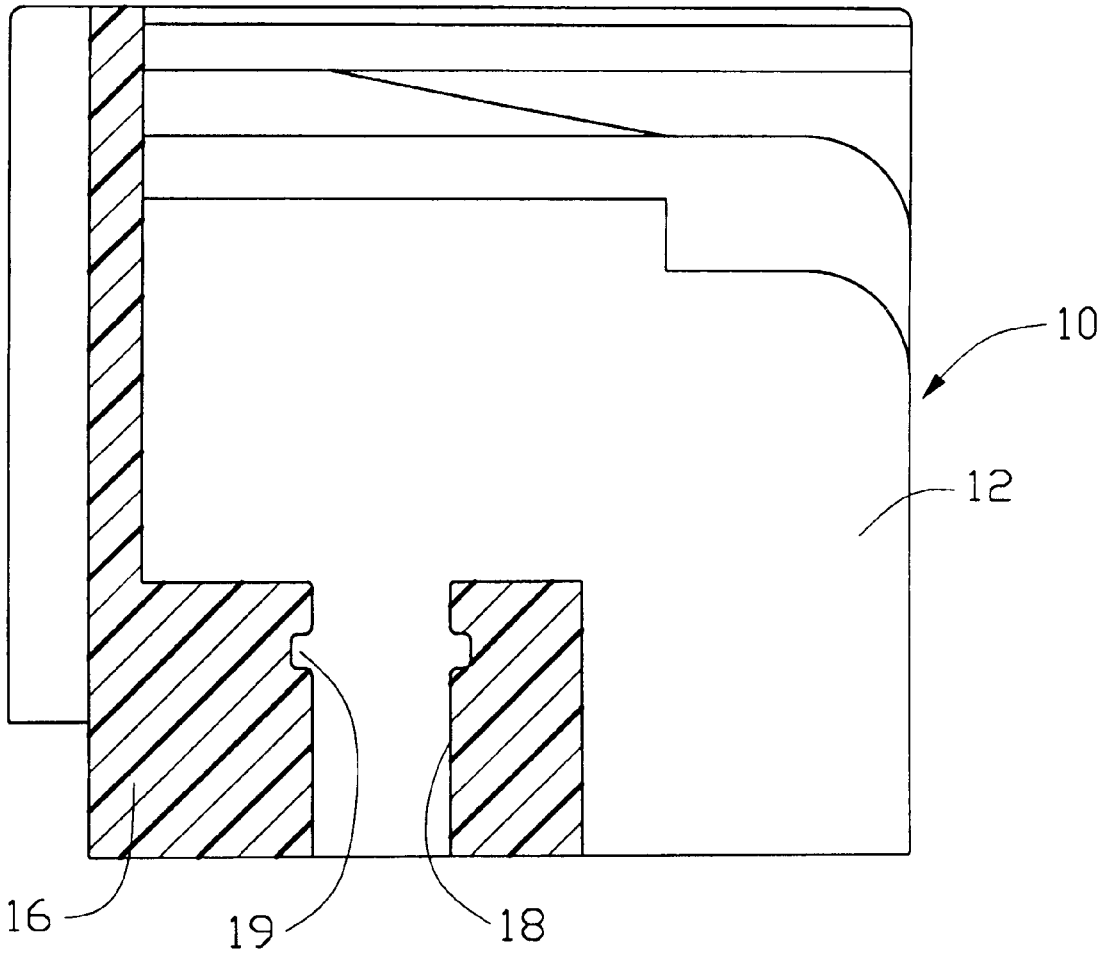
FIG. 2 is a cross sectional view taken from line 2—2 of FIG. 1.

Referring to FIGS. 1 to 2, an electrical connector in accordance with a first embodiment of the present invention comprises an insulative housing 10, a holding device 20, and a plurality of electrical contacts (not shown).

The housing 10 comprises a top wall 11, two side walls 12, 13, and a bottom wall 14 forming a plurality of passageways 15 therein. The passageways 15 receive the plurality of electrical contacts (not shown) of the electrical connector therein. The side wall 12 forms a pair of plates 16 on an outer lower surface thereof. The plates 16 define a guiding channel 17 therebetween and a pair of engaging grooves 18 at either side of and in communication with the guiding channel 17, and between the plates 16 and the side wall 12. The width of the guiding channel 17 is less than the widths of the engaging grooves 18. A pair of recesses 19 is defined in the plates 16 extending laterally from and in communication with the engaging grooves 18. Optionally, both of the side walls 12, 13 form the plates 16, guiding channels 17, engaging grooves 18, and recesses 19, if desired.

The holding device 20 comprises a U-shaped interferential portion 21, a transitional portion 22, and a mounting portion 23. The U-shaped portion 21 comprises a pair of legs 24 and a transverse section 25 between the legs 24. The legs 24 are parallel to each other and form a pair of barbs 26 directed away from each other on outer sides of the legs 24. The mounting portion 23 is in the shape of a flat plate and has an embossment 27 in substantially a center thereof. The transitional portion 22 is curved and has a width slightly smaller than the guiding channel 17, and connects the transverse section 25 of the U-shaped portion 21 and the mounting portion 23.

In use, the U-shaped portion 21 of the holding device 20 is placed abuttingly against the outer surface of the side wall 12 and is inserted downwardly along a direction indicated by an arrow A into the engaging grooves 18 of the plates 16. The barbs 26 engage with the recesses 19 and the embossment 27 is interferentially fitted into a cavity (not shown) of a printed circuit board (not shown). Since the width of the guiding channel 17 is smaller than the widths of the engaging grooves 18, the U-shaped portion 21 is confined by the pair of plates 16 from moving away from the side wall 12.

Figure 3:
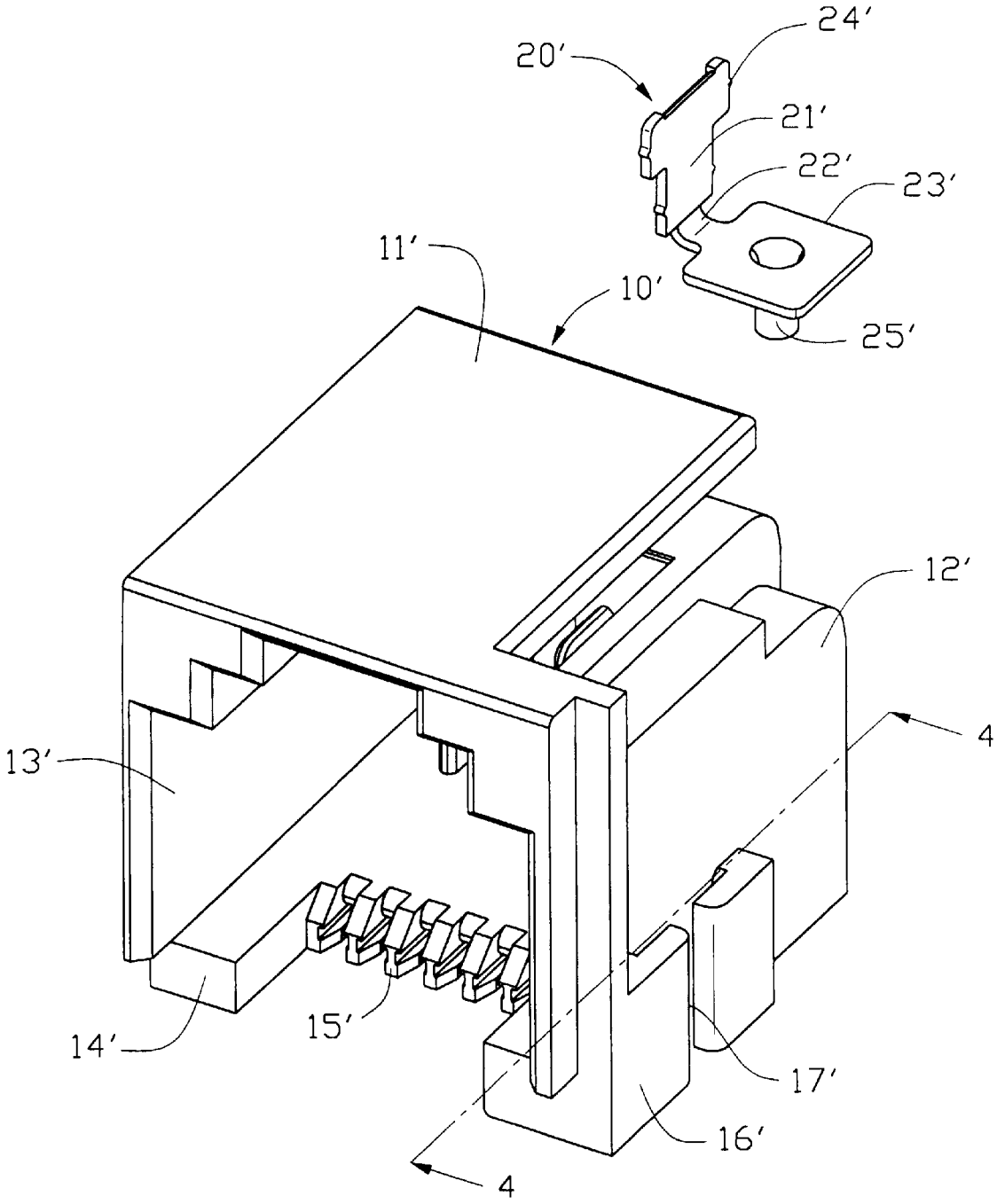
FIG. 3 is a perspective view of an electrical connector in accordance with a second embodiment of the present invention.
Figure 4:
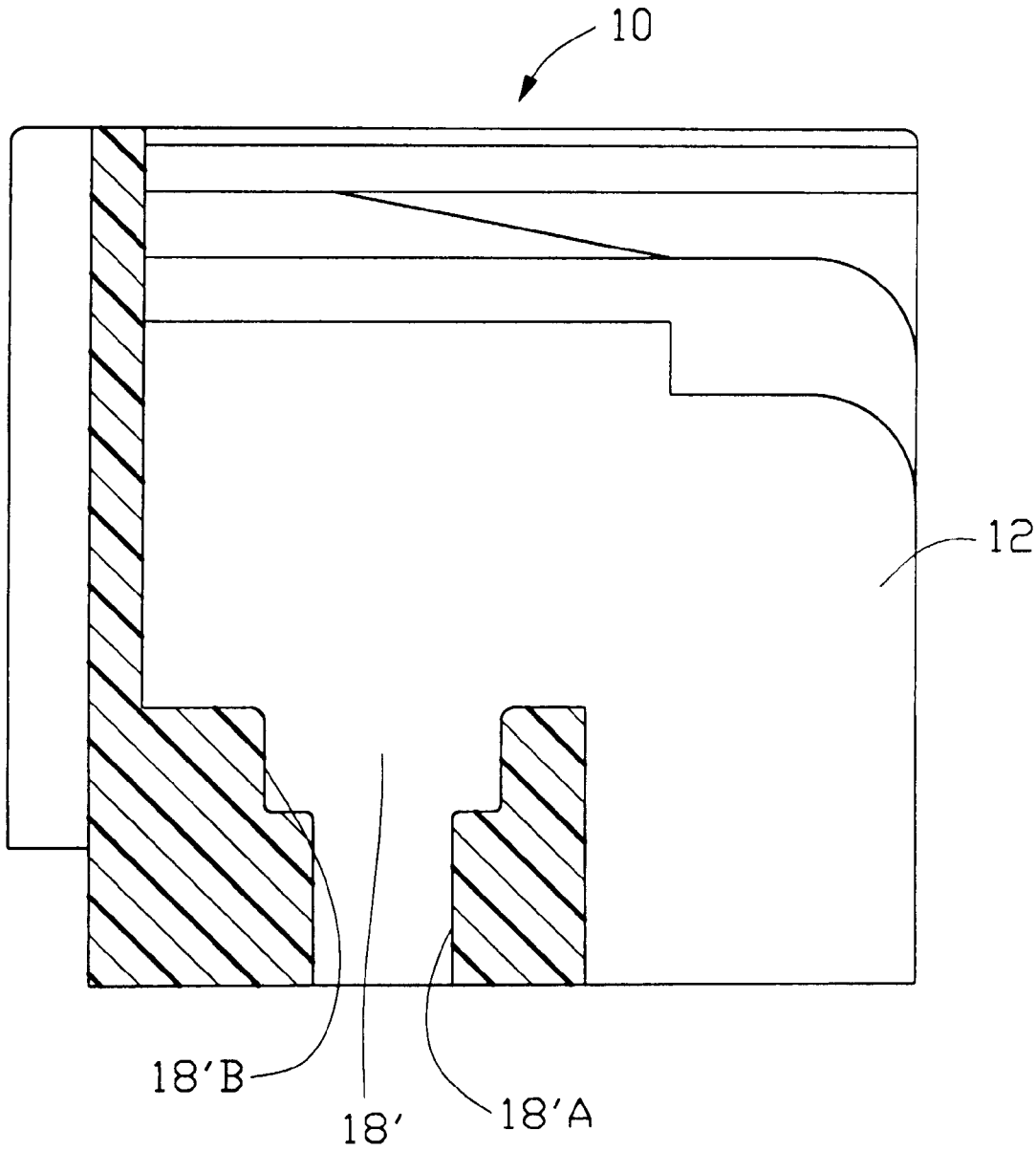
FIG. 4 is a cross sectional view taken from line 4—4 of FIG. 3.

Referring to FIGS. 3 to 4, an electrical connector in accordance with a second embodiment of the present invention comprises an insulative housing 10', a plurality of electrical contacts (not shown), and a holding device 20'.

The housing 10' comprises a top wall 11', two side walls 12', 13', and a bottom wall 14' forming a plurality of passageways 15' therein. The passageways 15' receive the plurality of electrical contacts of the connector therein. The side wall 12' forms a pair of plates 16' on an outer lower surface thereof. The plates 16' define a guiding channel 17' therebetween and a pair of engaging grooves 18' at either side of and in communication with the guiding channel 17', between the plates 16' and the side wall 12', each engaging groove 18' including a first groove section 18'B and a second groove section 18'A. The second groove sections 18'A are positioned below and are in communication with the first groove sections 18'B, and are smaller in width than the first groove sections 18'B, and are larger in width than the guiding channel 17'. Optionally, each of the side walls 12',

13' forms the pair of plates 16', the guiding channel 17', and the engaging grooves 18' thereon, if desired.

The holding device 20' comprises a T-shaped interferential portion 21', a transitional portion 22', and a mounting portion 23'. The T-shaped portion 21' comprises two pairs of protrusions 24' on opposite side edges of a widened upper section thereof and a lower section thereof. The mounting portion 23' is in the shape of a flat plate and has an embossment 25' in substantially a center thereof. The transitional portion 22' is curved having a width substantially smaller than the width of the guiding channel 17' and connects the lower section of the T-shaped portion 21' and the mounting portion 23'.

In use, the T-shaped portion 21' of the holding device 20' is placed abuttingly against the outer surface of the side wall 12' and is inserted downwardly. The transitional portion 22' moves along the guiding channel 17'. The widened upper section of the T-shaped portion 21' is received in the first groove sections 18' B and the lower section of the T-shaped portion 21' is received in the second groove sections 18' A of the plates 16'. The protrusions 24' increase the interferential force between the T-shaped interferential portion 21' and the engaging grooves 18'. Since the width of the guiding channel 17' is smaller than the widths of the widened upper section and the lower section of the T-shaped interferential portion 21', the T-shaped interferential portion 21' is confined in the engaging grooves 18' by the plates 16'. The embossment 25' is interferentially fitted into a cavity (not shown) of a printed circuit board (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An arrangement for securing an electrical connector to a printed circuit board, comprising:

an insulative housing comprising a side wall, the side wall having a pair of plates on an outer surface thereof, the pair of plates defining a guiding channel therebetween, and the pair of plates and the side wall defining a pair of engaging grooves at either side of and in communication with the guiding channel; and a holding device comprising an interferential portion, a mounting portion for mounting to a printed circuit board, and a transitional portion interconnected between the interferential portion and the mounting portion, the transitional portion being movable along the guiding channel to secure the interferential portion in the engaging grooves;

wherein the interferential portion of the holding device is U-shaped and comprises a pair of legs and a transverse section, each leg having a barb;

wherein the plates of the housing each have a recess in communication with the engaging grooves for receiving the barb of the respective leg;

wherein the interferential portion of the holding device is interferentially fitted into the engaging grooves and is confined by the plates;

wherein the mounting portion has an embossment therein for mounting to the printed circuit board.

* * * * *